United States Patent [19]

Herring

[11] Patent Number: 4,878,431

[45] Date of Patent: Nov. 7, 1989

[54] ELASTOMERIC INSULATING MATERIALS FOR ROCKET MOTORS

[75] Inventor: Liles G. Herring, Waco, Tex.

[73] Assignee: Hercules Incorporated, Wilmington, Del.

[21] Appl. No.: 832,110

[22] Filed: Feb. 21, 1986

[51] Int. Cl.[4] ..... C06D 5/06

[52] U.S. Cl. ..... 102/290; 102/291; 60/255; 149/19.9; 523/138; 523/179

[58] Field of Search ..... 523/138, 179, 413, 445, 523/447; 102/290–292; 149/19.9, 19.93; 60/253, 255

[56] References Cited

U.S. PATENT DOCUMENTS

| | | | |
|---|---|---|---|
| 3,883,375 | 5/1975 | Mastrolia et al. | 149/19.9 |
| 3,973,397 | 10/1976 | Chase et al. | 102/290 X |
| 4,492,779 | 1/1985 | Junior et al. | 523/138 |
| 4,600,732 | 7/1986 | Junior et al. | 523/138 |

*Primary Examiner*—Peter A. Nelson

*Attorney, Agent, or Firm*—Edmund C. Ross, Jr.

[57] ABSTRACT

Non-asbestos elastomeric insulating materials for rocket motors are disclosed. The insulating materials are low in density (between about 0.035 and 0.050 lb./cubic inch) and comprise crosslinked elastomeric polymers (100 parts by weight of a crosslinkable elastomeric polymer that is substantially saturated and about 5–50 parts by weight of a crosslinkable, substantially unsaturated, elastomeric polymer) in which are dispersed between about 10 and 100 (preferably 15–75) parts by weight of a char forming organic fiber selected from polyaramide pulps, between 1 and 15 parts by weight of a peroxide crosslinker, and between about 0 and 150 parts by weight organic and/or inorganic particulate. The insulating materials issue little smoke, have notable erosion resistance and can be tailored to have thermal, mechanical and other properties of desired character. Ingredients such as supplemental elastomers, oils and lubricants enhance the processability and green properties such as tack of the insulating materials.

14 Claims, 1 Drawing Sheet

ELASTOMERIC INSULATING MATERIALS FOR ROCKET MOTORS

The United States Government has rights in this invention under Contract FO4611-83-C-0006 awarded by the Air Force.

BACKGROUND OF THE INVENTION

1. Field of Use

This invention relates to improvements in the processability of elastomeric insulating materials that are asbestos free and especially suited for use as low smoke insulating in rocket motors. This invention, still more particularly, relates to improvements in the green properties of such elastomeric insulating materials that contain char forming organic fiber selected from polyaramide pulps as low density fillers which enhance the mechanical properties of the insulators and form a strong, adherent char upon cure and propellant burn.

Elastomeric insulating materials containing asbestos have long been employed within rocket motor cases including such portions thereof as their blast tubes. This invention relates to insulating materials which are similarly suited for use in rocket motors but are advantageously free of asbestos. U.S. Pat. No. 4,501,841 relates to elastomer formulations that have ingredients similar to those in the insulator formulations of this invention. However, the insulators specifically disclosed in U.S. Pat. No. 4,501,841 are difficult to process by calendaring or extrusion. Moreover, the green insulators specifically disclosed in U.S. Pat. No. 4,501,841 do not always have sufficient green strength for permitting them to be extruded or calendared optimally into ribbons that may be layed down with integral segments thereof tacking together in a manner such as disclosed in U.S. Ser. No. 378,588 filed May 17, 1982.

2. Objects of the Invention

It is an object of this invention to provide improved processability for low density, elastomer insulating materials useful in rocket motors.

It is an object of this invention to provide such elastomeric insulating materials in which certain char forming organic fiber replaces asbestos.

It is an object of this invention to provide such asbestos free elastomeric insulating materials that are low in smoke issuance and exhibit certain important properties as least as good as insulating materials containing asbestos.

It is an object of this invention to provide methods for compounding and use of these elastomeric insulating materials such that they may be readily calendered or extruded and yield green elastomeric material with desirable tack and physical properties.

These and other objects are achieved in accordance with practices of this invention; these practices are described more fully in the following together with the manner in which such objects are accomplished.

As used in the following description of this invention, the term "case wall insulation" refers to a layer or layers of material bonded to the internal wall of the rocket motor case to protect the case from the hot combustion processes occurring during the functioning of the rocket motor.

The term "blast tube insulation" in the following refers to material used to line the internal diameter of the blast tube of a rocket. The term "blast tube" refers to the conduit that conveys combustion products of the motor to the nozzle of the rocket. In some rocket motors, due to missile design, the nozzle cannot be connected directly to the rocket motor thereby requiring such a "blast tube." The blast tube lining protects this tube from the hot combustion gases of the rocket motor. "Blast tube ramp insulator" as used herein refers to the insulation material carried by an aftly converging section of a rocket motor between the rocket motor case (larger diameter) and the blast tube (smaller diameter). The term "low smoke" in reference to the elastomeric insulating materials of this invention means that firing of rockets in which these materials serve as insulation yields little or no smoke attributable to the insulations.

The nature of specific blast tube and blast tube ramp insulators, as well as case wall insulators, depends on both mass flux, in the area of application, and burning duration of the rocket motor.

FIGS. 1(*a*) and 1(*b*) show an extrusion die, respectively, in section and elevation. The die is used in testing the processability of elastomeric compositions of Examples 3 and 4.

BRIEF SUMMARY OF THE INVENTION

The improved non-asbestos elastomeric insulating material of this invention comprises an elastomeric polymer that is substantially saturated and a substantially unsaturated elastomeric polymer. There are between about 10 and 100 (more preferably between about 15 and 75) parts by weight of a char forming organic fiber selected from polyaramide pulps and preferably between about 0 and 150 parts by weight organic or inorganic particulate such as phenolic or silica particulate dispersed in the insulating material, these parts by weight based on 100 parts by weight of the substantially saturated elastomeric polymer.

Among the crosslinkable substantially saturated elastomeric polymers suitable for this invention are the synthetic rubbers: ethylene propylene diene monomer (EPDM), polyurethane, chlorosulfonated polyethylene and polychloroprene. These rubbery polymers are crosslinked by peroxy or other crosslinking agents formulated in the elastomeric insulating compounds. Among the substantially unsaturated elastomeric polymers are polyisoprenes. In the embodiment of this invention relating to provision of rocket motor cases insulation, this invention comprises providing a compound comprising: 100 parts by weight of a substantially saturated elastomeric polymer (which is preferably a synthetic elastomer polymer noted above); about 5–50 parts by weight of a crosslinkable substantially unsaturated elastomeric polymer; about 1–15 parts by weight peroxy crosslinker; about 10–100 parts by weight polyaramide pulp; and about 0–120 parts by weight particulate selected from inorganic and organic particulate and combinations thereof. The compound is formed into a tacky ribbon as by extrusion or calendaring and wound about a workpiece (such as a rocket motor case mandrel). Integral segments of the ribbon are layed adjacent each other and tack together in forming a layer of elastomer which can be cured prior to lay down or thereafter to form the rocket motor case insulation.

DETAILED DESCRIPTION OF THE INVENTION

Figure 1A:
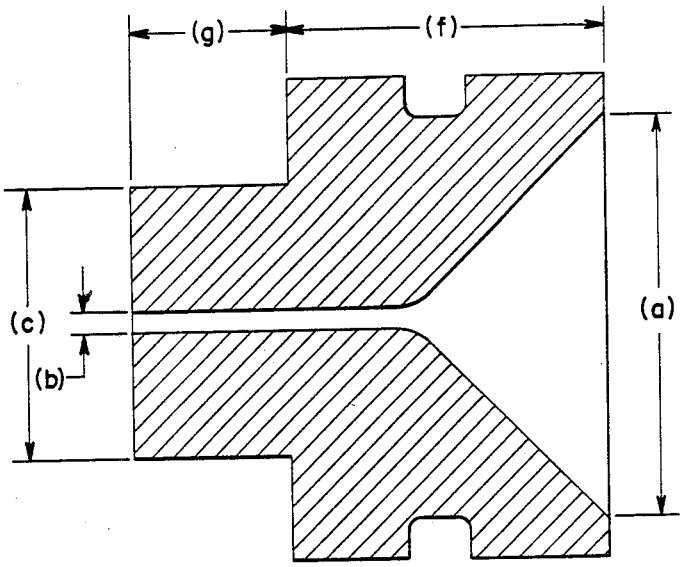

Elastomeric insulating materials of this invention can serve such uses as case wall and blast tube ramp insulations for rocket motors.

In addition to crosslinked elastomer polymers, the elastomeric insulating materials, most importantly, contain intimately dispersed char forming organic fiber comprising polyaramide pulp. The polyaramide pulp functions as a low density filler in the insulating materials that enhances mechanical properties thereof. The aromatic character of the polyaramide pulp advantageously promotes formation of a strong, adherent char from the elastomer insulating materials during propellant burning.

The polyaramide pulp suitable for use in this invention is commercially available, sold for example, by E. I. duPont as Kevlar$^R$ aramide pulp fiber. The polyaramide pulp preferably is a short, highly fibrillated fiber in which the fibrillation is resultant of axially oriented, crystallites that are less strongly bonded transversely. The fibrillation provides length to diameter ratios for the pulps that are preferably in a range above about 500.

The preferred polyaramide pulps have physical properties as set forth in Table I:

TABLE I

| | |
|---|---|
| Tensile Strength KPa × $10^3$ | 3000–4000 |
| Tensile Modulus KPa × $10^6$ | 75–100 |
| Elongation % | 3–5 |
| Density g/cc | 1.4–1.5 |
| Filament Dia. um | 10–14 |
| Degradation Temp. | 400–600° C. |
| Thermal Expansion Coefficient | $-2 \times 10^{-6}$/°C. |

Exemplary particle size characterizations for polyaramide pulps currently available for use in this invention are set forth in Table II below:

TABLE II

| | A* | B* | C* |
|---|---|---|---|
| +14 Mesh | 16 +/− 5 | 4 +/− 2 | 4 +/− 2 |
| −14 +30 Mesh | 22 +/− 5 | 17 +/− 3 | 17 +/− 3 |
| −30 +50 Mesh | 25 +/− 3 | 33 +/− 5 | 33 +/− 5 |
| −50 +100 Mesh | 19 +/− 4 | 26 +/− 2 | 26 +/− 2 |
| −100 Mesh | 17 +/− 5 | 20 +/− 4 | 20 +/− 4 |
| Nominal Average Length | 4 mm | 2 mm | 2 mm |

*Kevlar pulps sold by Dupont as Long Wet Lap, Merge 6F204; Short Wet Lap Merge 6F205; and Dry Pulp Merge 6F218, respectively.

The dry pulp C of Table II is preferred for this invention. Drying of the wet pulps B and C prior to compounding is preferred for their use in this invention.

This invention is not limited to any particular substantially saturated elastomeric polymer. As long as the polymer is a crosslinkable and moldable solid, the advantages of this invention are obtainable. Exemplary polymers, however, are polychloroprene, chlorosulfonated polyethylene, polyurethane, and ethylene propylene diene monomer (EPDM) rubbers.

Specific suitable EPDM polymers are available as Nordel$^R$ 1040 from Dupont, Royalene$^R$ 100 from Uniroyal, Epsyn$^R$ 4506 from Copolymer and Vistalon$^R$ 2504 from Exxon.

Preferred EPDM polymers have the following properties:

| | |
|---|---|
| Density, g/cc | 0.85 to 0.865 |
| Mooney, ML-4 @ 212 F. | 25 to 60 |
| Brittle Point, °F. | −90° F. |
| Hardness, Short A | 30 to 90 |

-continued

| | |
|---|---|
| Tensile Strength (gumstock, psi) | 500 to 1000 |

Polychloroprenes suitable for use in this invention are commercially available. Polychloroprenes can be made by reacting vinylacetylene with chlorine gas to form a chloroprene followed by polymerization in the presence of base to yield the desired polychloroprene. Preferred polychloroprenes are crystallization resistant, an example of which is Neoprene WRT from Dupont.

Polyurethane polymers suitable for this invention are commercially available crosslinkable solids and are made by reacting an active hydrogen compound (e.g. polyol or polyester) with a polyisocyanate in quantities that do not lead to extensive crosslinking.

Chlorosulfonated polyethylenes are commercially available as, for example, Hypalon$^R$ polymers from Dupont. These polymers can be made by reacting polyethylene with up to about 45% by weight chlorine and a sulfur oxide such that these polymers contain between about 30 and 40% by weight chlorine and between about 1 and 3% by weight sulfur.

The substantially unsaturated elastomeric polymer that supplements the relatively saturated elastomeric polymer preferably is a polyisoprene with a Mooney viscosity between about 60 and 100 at 25° C. Another example is natural rubber. Preferably, at least about 20 phr of the substantially unsaturated elastomeric polymer is used in the insulating material. The peroxide curing agent used in the insulator formulations cure the supplemental polymer.

Inorganic reinforcing particulate can be included in the elastomeric insulating materials of the invention; the inorganic particulate is preferably hydrated silica which has a particle size of between about 10 and 50 microns. Other such inorganic particulates that can be suitably employed include such siliceous materials as mica and quartz.

The insulating materials may have additives to enhance the flame retardant properties of the insulation. For example, chlorinated organic compounds can be used with antimony oxide or hydrated alumina to further enhance flame retardance of the insulating materials. An exemplary chlorinated hydrocarbon for this purpose is Dechlorane$^R$ flame retardant. The organic flame retardant is typically used at between about 10 and 80 phr, more preferably 15 and 65 phr where phr as used herein refers to parts by weight per 100 parts of the aforementioned substantially saturated elastomeric polymer. Antimony oxide or hydrated alumina is preferably used with the organic flame retardant at levels between about 5 and 40 phr, more preferably between about 10 and 30 phr.

Liquid polybutadiene is an organic material which can be advantageously employed in compounding certain of the elastomeric insulating materials of this invention. Suitable liquid polybutadienes are unsaturated and have molecular weights (number average) between about 1000–5000. Advantage in use of the liquid unsaturated polybutadienes results from their ability to aid in dispersing the polyaramide pulp during compounding of the elastomeric insulating material. A typical level is between about 1 and 50 phr, more preferably 5 and 20 phr of the liquid polybutadiene. An exemplary liquid polybutadiene is Butarez$^R$ NF from Phillips Petroleum; another is Ricon$^R$ 150 from Colorado Specialities.

Phenolic resins can be employed, typically between about 30 and 125 phr, for increasing char formation and enhance erosion resistance, particularly in chlorosulfonated polyethylene insulating materials of this invention. Exemplary phenolic resin products for this purpose are Resinox$^R$ materials from Monsanto. The use of phenolic resins enable the elastomeric insulating materials to cure into a rigid, hard body.

Among the peroxy crosslinking agents which can be used for crosslinking of elastomeric insulating compounds of this invention are: 1,1-di(t-butylperoxy)3,3,5-trimethylcyclohexane; t-butylperoxy-2-ethylhexaneoate; t-butylperoxybenzoate; 2,5-dimethyl-2,5-di-(benzoylperoxy)hexane; t-butylperoxymaleic acid; dicumyl peroxide; 2,5-dimethyl-2-5-di(t-butylperoxy)hexane and di-t-butylperoxide. The peroxy crosslinking agents are used in amounts which preferably range between about 1 and 10 phr.

For chlorosulfonated polyethylene polymers, a starch or other polyol and magnesium or zinc oxide curing system is preferred to obtain desired crosslinking; addition of peroxy crosslinking agents in compounding with these polymers is for crosslinking of the substantially unsaturated elastomeric polymer which is advantageously included in the formulations. The polyol and metal oxide curing systems can be used at a range of between about 2 and 50 phr. Pentaerythritol used as a polyol in the curing system is included in a range of between about 2 and 50 phr. Pentaerythritol used as a polyol in the curing system is included in a range between about 0.5–5 phr. Starch is ordinarily employed as the polyol at higher levels, e.g. 10–80 hr.

Polychloroprene polymers are preferably crosslinked with metal oxide such as zinc or magnesium oxide. Like the chlorosulfonated polyethylene compounds, the polychloroprene compounds used in making the elastomeric insulating materials of this invention also are used with substantially unsaturated elastomeric polymers and peroxy crosslinking agents. In polyurethane formulations, liquid polyesters serve a similar purpose as liquid polybutadiene.

The elastomeric insulation materials of this invention may be from flexible to rigid using ingredients as above described. High levels of reinforcing particulate, up to about 80% by weight of the elastomeric insulating materials, can be used for modifying the modulus as desired for particular applications. Additional ingredients may also be incorporated in the elastomeric insulating compositions of this invention. For example, tackifiers, lubricants, plasticizers and the like may be incorporated for further enhancements.

Set forth in Tables A, B, C, C and E below are exemplary formulation ranges for the elastomeric insulationg materials of this invention. Advantageously, specific cured elastomer insulators can be selected to have high erosion resistance comparable or better than their asbestos containing analogs as well as desirable thermal and mechanical properties including bonding capacity to standard propellants and bonding agents.

TABLE A

| Ingredient | Parts by Weight |
|---|---|
| Chlorosulfonated Polyethylene | 100 |
| Supplemental Solid Elastomer* | 5–50 |
| Liquid Polybutadiene | 0–30 |
| Magnesia | 1–5 |
| Hydrated Silica | 0–30 |
| Polyaramide Pulp | 30–50 |
| Accelerator | 0.5–5 |

TABLE A-continued

| Ingredient | Parts by Weight |
|---|---|
| Peroxy Crosslinking Agent | 1–5 |
| Polyol Curing Agent | 1–40 |

The elastomeric insulating materials of this embodiment A have superior erosion resistance and low smoke. Density typically ranges between about 0.042 and 0.048 pounds per cubic inch for these insulations. When phenolic resin such as Resinox$^R$ is included at between about 80–125 phr., the resultant insulation is a rigid body and can be used as a blast tube ramp or insulator.

TABLE B

| Ingredient | Parts by Weight |
|---|---|
| Polychloroprene | 100 |
| Magnesium oxide | 1–5 |
| Peroxy Crosslinking Agent | 0.5–5 |
| Polyaramide Pulp | 30–80 |
| Liquid Polybutadiene | 10–30 |
| Hydrated Silica | 10–30 |
| Supplemental Solid Elastomer* | 5–50 |

*Substantially unsaturated, crosslinkable elastomer polymer.

The elastomeric insulating materials of this embodiment B have good erosion resistance, low smoke and, advantageously, do not absorb significant amounts of low polarity plasticizer from propellants containing the same. Density typically ranges between about 0.045 and 0.050 pounds per cubic inch for these insulations.

TABLE C

| Ingredient | Parts by Weight |
|---|---|
| EPDM | 100 |
| Peroxy Crosslinking Agent | 1–5 |
| Organic Flame Retardant | 20–60 |
| Inorganic Flame Retardant | 10–40 |
| Polyaramide Pulp | 10–60 |
| Supplemental Solid Elastomer* | 5–50 |
| Hydrocarbon Oil | 0–10 |

The elastomeric insulating materials of this embodiment C are especially suited to case wall insulation in view of flame retarding and physical and thermal properties thereof. Density typically ranges between about 0.30 and 0.040 pounds per cubic inch for these insulations.

TABLE D

| Ingredient | Parts by Weight |
|---|---|
| EPDM | 100 |
| Supplemental Solid Elastomer* | 5–50 |
| Peroxy Crosslinking Agent | 1–5 |
| Liquid Polybutadiene | 0–25 |
| Polyaramide Pulp | 20–80 |
| Hydrated Silica | 10–30 |

*Substantially unsaturated, crosslinkable elastomer polymer.

The elastomeric insulating of this embodiment D of this invention are of relatively low smoke and are desirably employed as flexible, low density insulators having superior erosion, mechanical and thermal properties as well as bond strengths. Density typically ranges between about 0.035 and 0.042 pounds per cubic inch for these insulations.

| Ingredient | Parts by Weight |
|---|---|
| Polyurethane | 100 |

-continued

| Ingredient | Parts by Weight |
|---|---|
| Peroxy Crosslinking Agent | 0.5–5 |
| Hydrated Silica | 10–30 |
| Polyaramide Pulp | 30–70 |
| Processing Aids | 5–15 |

The elastomeric insulating materials formulated with ingredients as shown in Table E have use as low smoke case wall insulation. Density typically ranges between about 0.045 and 0.050 pounds per cubic inch for these insulations.

Compounding of the insulating materials of this invention is at temperatures below those which cure the elastomeric polymer and permit loss of compounding ingredients. Normally, these temperatures are below about 250° F. Conventional mixing and milling equipment can be used in the compounding.

The elastomeric insulating materials of this invention can be applied to motor cases by wrapping a "bladder mandrel" with calendared sheets of the insulator. The bladder is then inserted into the case and inflated. The inflated bladder forces the insulation against the motor case (or ramp) where it consolidates under pressure. The assembly, with inflated bladder, is then placed in an oven where the insulator is cured. Oven temperature of 250° F. to 350° F. are commonly used. For curing with peroxide, a minimum temperature of about 310° F. is usually required. After the curing, the bladder is removed leaving an insulated motor case. It is often advantageous to use primers on metal case walls to enhance bonding of the elastomeric insulating material. Primers such as Chemlok 233 or a combination of Chemlok 205 and 234B (products of Hughson Division of Lord Corporation) can be used.

Alternative to the use of the aforedescribed inflatable mandrel technique, the elastomeric insulating materials can be molded in matched metal dies for subsequent bonding to the rocket motor case. Moreover, formulations of the elastomeric inuslating materials can be adapted to the process of U.S. Ser. No. 378,588 filed May 17, 1982 (incorporated herein by reference) which utilizes ribbon material in making precision rocket motor case insulation in automated fashion.

The following examples further illustrate aspects of this invention. The illustration by way of these examples is not intended to limit the scope of this invention but, rather, to demonstrate its varied practice.

As used in these examples erosion rate is defined as the thickness of elastomeric insulating material before test less thickness after the test divided by action time where action time is the time between when the motor starts to exhaust at 100 psi and when the motor exhaust tails off to 100 psi. Char rate is defined as elastomeric insulating material thickness after test minus thickness after removal of char divided by the action time. Decomposition rate is defined as the elastomeric insulating material thickness before test minus thickness after char removal divided by the action time. Values of the aforedefined rates designated with a plus (+) sign indicate swelling of material during the test firing such that the subtraction, noted above, leads to a positive number.

Figure 1B:
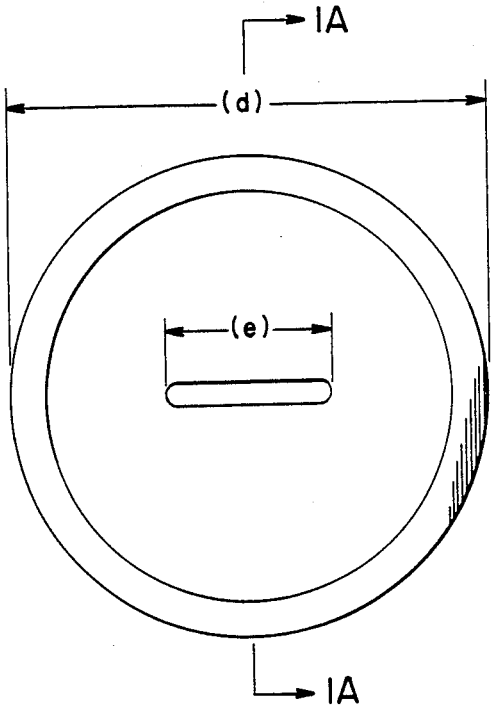

Mechanical properties (Examples 3 and 4) were obtained with an Instron$^R$ Tensile Tester using the procedures described in ASTM D412, Extrusion values (Examples 3 and 4) were obtained from samples prepared on a ribbon extruder having a barrel 38 mm in diameter and a slit die, as shown in FIG. 1(*a*) and (*b*). Dimensions (inches) of the die of FIGS. 1(*a*) and 1(*b*) were as follows:

| | |
|---|---|
| (a) 1.256–1.258 | (e) 0.050–0.055 |
| (b) 0.040–0.050 | (f) 1.0 |
| (c) 0.875 | (g) 0.5 |
| (d) 1.493–1.496 | |

Viscosities shown in Examples 3 and 4 were determined at 100° C. using a Mooney viscometer with tests conducted according to ASTM D1646.

EXAMPLE 1

Set forth in Table 1 below are specific formulations for elastomeric insulating materials of this invention. The insulating materials were generally compounded at temperatures below 250° F. with roll mixers held at between about 40° and 80° F. as follows:

| Order of Addition | Range of Mixing Times |
|---|---|
| Elastomer Polymer(s) | 1–10 minutes |
| Peroxy Curing Agent | 2–10 minutes |
| Flame Retardant, if any | 10–15 minutes |
| Inorganic particulate | 5–10 minutes |
| Organic polymer additive, if any | 5–10 minutes |
| Polyaramide Pulp | 10–15 minutes |

When liquid polybutadiene was used, it was added with the polyaramide pulp to keep effective mixing of the pulp.

The compounded materials were cured at temperatures between about 310° and 350° F. for times of up to about an hour with thickness of 0.2 inches of the test samples. Tables 2, 3, 4, 5 and 6 list the properties of formulations A, B, C, D and E of Table 1, respectively.

TABLE 1

| Ingredients, phr | A | B | C | D | E |
|---|---|---|---|---|---|
| EPDM[a] | 100.0 | | 80.0 | | |
| 2,5-dimethyl-2,5-di-(t-butylperoxy) hexane[b] | 2.5 | 2.5 | 2.5 | 1.25 | 2.5 |
| Polyaramide Pulp[c] | 20.0 | 50.0 | 50.0 | 50.0 | 50.0 |
| Antimony oxide | 20.0 | | | | |
| Chlorinated compound[d] | 40.0 | | | | |
| Liquid polybutadiene[e] | 10.0 | | | | |
| Polychloroprene Rubber[f] | | 80.0 | | | |
| Hydroxy-terminated polybutadiene[g] (liquid) | | 20.0 | | | |
| Silica[h] | | 20.0 | 20.0 | 20.0 | 20.0 |
| Magnesium oxide | | 2.4 | | 2.00 | |
| Liquid polybutadiene (high vinyl)[i] | | | 20.0 | 20.0 | |
| Chlorosulfonated polyethylene[j] | | | | 80.0 | |
| Pentaerythritol[k] | | | | 1.50 | |
| Dipentamethylenethiurium-hexasulfide[l] | | | | 1.00 | |
| Polyurethane rubber[m] | | | | | 100.0 |

TABLE 1-continued

| Ingredients, phr | A | B | C | D | E |
|---|---|---|---|---|---|
| Polyester-polyol[n] | | | | | 10.0 |

[a]Nordel 1040 product of DuPont
[b]Varox product of R. T. Vanderbilt
[c]Kevlar 29 Pulp product of DuPont
[d]Dechlorane Plus 515 product of Hooker Chemical
[e]Butarez NF product of Phillips Petroleum
[f]Neoprene WRT product of DuPont
[g]Hycar 1300 × 16 product of B. F. Goodrich
[h]Hi-Sil 233 product of Harwick Chemical
[i]Ricon 150 product of Colorado Specialties
[j]Hypalon LD-999 product of DuPont
[k]P.E. 200 product of Hercules Incorporated
[l]Tetrone A product of DuPont
[m]Vibrathane 5004 product of Uniroyal
[n]Multron R-18 product of Mobay

TABLE 2

| Formulation A Characteristics: | | | | |
|---|---|---|---|---|
| 1. Cure conditions (time at def F) | 30 min. @ 350° F. | | | |
| 2. Mechanical Properties | | | | |
| Test Temp. | 77° F. | | −65° F. | 170° F. |
| Fiber Direction | ** | * | ** | ** |
| Tensile Strength, psi | 1645 | 540 | 5840 | 1114 |
| Elongation, % | 30 | 145 | 13 | 20 |
| 3. Hardness, Shore A | 85 | | | |
| 4. Density, lb/in$^3$ | 0.0411 | | | |
| 5. Tg, Degrees F. | −74 | | | |
| 6. Thermal Conductivity, BTU/lb deg F. | 0.118 | | | |
| 7. Thermal Diffusivity | 0.0033 | | | |
| 8. Specific Heat Cal/gm - °C. | 0.42/0.50/ 0.51 @ 66/94/150° C. | | | |
| 9. Erosion Date (Minimum Smoke) | | | | |
| Test Motor | Two Inch | | Six Inch | |
| Mass Flux, lb/sec in$^2$ | 0.245 | | 0.245 | |
| Erosion Rate, mil/sec | 0 | | +10 | |
| Char Rate, mil/sec | 8 | | 20 | |
| Decomposition Rate mil/sec | 8 | | 10 | |
| 10. Smoke, Colored Photos with Min. Smoke Propellant | None | | | |
| 11. Compatibility | | | | |
| Minimum Smoke Propellant | Acceptable | | | |
| Composite HTPB | Acceptable | | | |
| 12. Bond, Steel | | | | |
| Peel (90°), pli | 5/17[1] | | | |
| Tensile, psi | 213/265[1] | | | |

[1]Primed with Chemlok 233, epoxy adhesive from Hughson Chemical (Lord)
*Perpendicular fiber orientation in test samples resulting from milling and cutting across direction of oriented fiber in milled product.
**Parallel fiber direction in test samples, resulting from milling and cutting with direction of oriented fiber in milled products.

TABLE 3

| Formulation B Characteristics: | | | | |
|---|---|---|---|---|
| 1. Cure conditions (time at def F.) | 45 min. @ 310 | | | |
| 2. Mechanical Properties | | | | |
| Test Temp. | 77° F. | | −65° F. | 170° F. |
| Fiber Direction | ** | * | ** | ** |
| Tensile Strength, psi | 2837 | 1382 | 4172 | 824 |
| Elongation, % | 10 | 20 | 9 | 12 |
| 3. Hardness, Shore A | 96 | | | |
| 4. Density, lb/in$^3$ | 0.04791 | | | |
| 5. Tg, Degrees F. | −36 | | | |
| 6. Thermal Conductivity, BTU/lb deg F. | 0.133 | | | |
| 7. Thermal Diffusivity | 0.0045 | | | |
| 8. Specific Heat Cal/gm - °C. | 0.34/0.35/ 0.36 @ 66/94/150° C. | | | |
| 9. Erosion Date (Minimum Smoke) | | | | |
| Test Motor | Two Inch | | Six Inch | |
| Mass Flux, lb/sec in$^2$ | 0.245 | | 0.245 | |
| Erosion, mil/sec | +4 | | +9 | |
| Char Rate, mil/sec | 12 | | 16 | |
| Decomposition Rate, mil/sec | 8 | | 7 | |
| 10. Smoke, Colored Photos with Min Smoke Propellant | None[1] | | | |
| 11. Compatibility Minimum Smoke propellant | Acceptable | | | |
| 12. Bond, Steel | | | | |
| Peel (90° C.), pli | 7/6[2] | | | |
| Tensile, psi | 1179/1107[2] | | | |

[1]Some after burning
[2]Without/With Chemlok 233
*Perpendicular
**Parallel

TABLE 4

| Formulation C | | | | |
|---|---|---|---|---|
| 1. Cure conditions (time at deg F.) | 30 min @ 350 | | | |
| 2. Mechanical Properties | | | | |
| Test Temp. | 77° F. | | −65° F. | 170° F. |
| Fiber Direction | ** | * | ** | ** |
| Tensile Strength, psi | 2446 | 988 | 5039 | 1040 |
| Elongation, % | 10 | 40 | 10 | 15 |
| 3. Hardness, Shore A | 95 | | | |
| 4. Density, lb/in$^3$ | 0.0388 | | | |
| 5. Tg, Degrees F. | −72 | | | |
| 6. Thermal Conductivity, BTU/lb deg F. | 0.124 | | | |
| 7. Thermal Diffusivity | 0.004 | | | |
| 8. Specific Heat Cal/gm - °C. | 0.46/0.43/0.44 @ 66/94/150° C. | | | |
| 9. Erosion Data (Minimum Smoke) | | | | |
| Test Motor | Two Inch | | Six Inch | |
| Mass Flux, lb/sec in$^2$ | 0.245 | | 0.245 | |
| Erosion Rate, mil/sec | 4 | | 7 | |
| Char Rate, mil/sec | 5 | | 18 | |
| Decomposition Rate mil/sec | 9 | | 12 | |
| 10. Smoke, Colored Photos with Min Smoke Propellant | None | | | |
| 11. Compatibility | | | | |
| Minimum Smoke Propellant | Acceptable | | | |
| Composite HTPB | Acceptable | | | |
| 12. Bond, Steel | | | | |
| Peel (90° C.), pli | 17/22[1] | | | |
| Tensile, psi | 663/565[1] | | | |

[1]Primed with Chemlock 233
*Perpendicular
**Parallel

TABLE 5

| Formulation D Characteristics: | | | | |
|---|---|---|---|---|
| 1. Cure Conditions (time at deg F.) | 30 mins @ 350 | | | |
| 2. Mechanical Properties | | | | |
| Test Temp. | 77° F. | | −65° F. | 170° F. |
| Fiber Direction | ** | * | ** | ** |
| Tensile Strength, psi | 3991 | 1300 | 2928 | 1148 |
| Elongation, % | 10 | 60 | 10 | 17 |
| 3. Hardness, Shore A | 95 | | | |
| 4. Density, lb/in$^3$ | 0.04552 | | | |
| 5. Tg, Degrees F. | −15 | | | |
| 6. Thermal Conductivity, BTU/lb deg F. | 0.0041 | | | |
| 7. Thermal Diffusivity | 0.0004 | | | |
| 8. Specific Heat Cal/gm - °C. | 0.37/0.39/0.44 @ 66/94/150° C. | | | |
| 9. Erosion Data (Minimum Smoke) | | | | |
| Test Motor | Two Inch | | Six Inch | |
| Mass Flux, lb/sec in$^2$ | 0.245 | | 0.245 | |
| Erosion Rate, mil/sec | +1 | | +4 | |
| Char Rate, mil/sec | 10 | | 14 | |
| Decomposition Rate, mil/sec | 9 | | 8 | |
| 10. Smoke, Colored Photos with | | | | |

TABLE 5-continued

| Formulation D Characteristics: | |
|---|---|
| Min Smoke Propellant | None |
| 11. Compatibility | |
| Minimum Smoke Propellant | Acceptable |
| Composite HTPB | Acceptable |
| 12. Bond, Steel | |
| Peel (90°), pli | 9/15(1) |
| Tensile, psi | 255(1) |

(1)Primed with Chemlok 233
*Perpendicular
**Parallel

TABLE 6

| Formulation E Characteristics: | | | | |
|---|---|---|---|---|
| 1. Cure conditions (time at deg F.) | | | 30 min @ 350 | |
| 2. Mechanical Properties | | | | |
| Test Temp. | | 77° F. | −65° F. | 170° F. |
| Fiber Direction | ** | * | ** | ** |
| Tensile Strength, psi | 3468 | 1548 | 3609 | 1863 |
| Elongation, % | 20 | 70 | 5 | 24 |
| 3. Hardness, Shore A | | | 92 | |
| 4. Density, lb/in$^3$ | | | 0.04766 | |
| 5. Tg, Degrees F. | | | −29 | |
| 6. Thermal Conductivity, BTU/lb deg F. | | | 0.164 | |
| 7. Thermal Diffusivity | | | 0.0045 | |
| 8. Specific Heat Cal/gm - °C. | | | 0.33/0.37/0.44 @ 66/94/150° C. | |
| 9. Erosion Data (Minimum Smoke) | | | | |
| Test Motor | | Two Inch | Six Inch | |
| Mass Flux, lb/sec in$^2$ | | 0.245 | | |
| Erosion Rate, mil/sec | | 3 | | |
| Char Rate, mil/sec | | 7 | | |
| Decomposition Rate, mil/sec | | 10 | | |
| 10. Smoke, Colored Photos with Min Smoke Propellant | | | None | |
| 11. Compatibility | | | | |
| Minimum Smoke Propellant | | | Acceptable | |
| Composite HTPB | | | Acceptable | |
| 12. Bond, Steel | | | | |
| Peel (90° C.), pli | | | 3(1) | |
| Tensile, psi | | | 51(1) | |

(1)Without primer
*Perpendicular
**Parallel

As can be noted from Tables 2–6, among the advantageous properties of the elstomeric insulating materials of this invention is the thermal conductivity thereof, i.e. in a range between about 0.11 and 0.13 BTU/lb/° F.

EXAMPLE 2

Set forth in Table 7 are results from using the elastomeric insulating materials (A, B, C and D) of Example 1 in test rocket motors having twelve pounds of propellant. The first column in Table 7, "Mass Flux", refers to the rate per unit area at which combustion products pass through such area of the rocket motors.

The data of Table 7 illustrate that elastomeric insulating materials of this invention exhibit exceptional erosion, char and decomposition rate making them outstanding candidates for use in tactical rocket motors as insulation for the case walls and blast tube ramps thereof. At low mass fluxes, the erosion rate is negligible.

TABLE 7

| Formulation | Mass Flux, lb/sec in$^2$ | Erosion Rate, mil/sec | Decomposition Rate, mil/sec |
|---|---|---|---|
| A | 0.180 to 0.216 | +3 | 8 |
| | 0.502 | +1 | 14 |
| | 1.97 | 94 | 93 |
| B | 0.172 to 0.220 | +9 | 8 |
| | 0.501 | 1 | 16 |
| | 1.77 | 42 | 47 |
| C | 0.174 to 0.215 | 6 | 12 |
| | 0.470 | 14 | 30 |
| | 1.80 | 66 | 67 |
| D | 0.174 to 0.214 | +3 | 8 |
| | 0.470 | 1 | 17 |
| | 1.90 | 49 | 49 |

In preparing samples for full scale rocket motor testing, five case and ramp type (insulators (A)–(E) of Table 1) were separately compounded on a 30-inch differential roll mill, where compounding was in 20- to 30-pound batches. After compounding, each material was sheeted on an even-speed roll mill to yield sheets approximately 36 inches×24 inches and at a thickness of 30 mils. These sheets were used to form the wall insulators for the full-scale (40 pound), minimum-smoke motor tests. Forming was performed with tooling used to form insulators for an existing rocket motor. This tooling accommodates a case 40 inches long, with a 9.35 inch inside diameter; an inflatable bladder was used to pressurize and mold the insulators against the inside diameter of the case. Forming and curing were carried out at a bladder pressure of 100 psig and a temperature of 340+/−5 F. Length of the tooling was sufficient to allow the molding of two insulators simultaneously, with dimensions of 9.3 inch outside diameter and 19 inch long.

No difficulties were encountered in forming the insulator sleeves from the above materials.

Longitudinal strips about 5 by 16 inches were cut from the molding and bonded into phenolic sleeves that could be slipped into the 40 pound test motor wall test section. The strips were bonded into the phenolic sleeve with a high temperature epoxy adhesive using a pressurized bladder to hold the insulator strips in place while the adhesive cured.

In addition to the case wall insulators, rings (9 inch outside diameter, 5.5 inch inside diameter, and 2-inches thick) were molded from formulation D of Table 1 as an approach section for the nozzles or blast tubes.

Forty pound motor evaluations consisted of four firings. Motors No. 1 through 3 contained specimens of the five wall insulators. Motors No. 2 through 4 were equipped with blast tube sections.

Motor No. 1 was a low pressure firing, containing the five case wall insulators and a nozzle entrance section of formulation D. Data, provided in Table 8, show excellent erosion resistance and low decomposition rates at amass flux of 0.164 lb/sec-in.$^2$ for elastomeric insulating materials of this invention.

Set forth in Table 8 are the results from firing these test rocket motors containing the forty pounds of propellant. "ER" and "DR" in Table 8 stand for "erosion rate" and "decomposition rate." The "wall section" is a section of the cylindrical portions of the rocket motors. The "ramp section" is a section between the cylindrical sections and blast tube sections of the rocket motors. As can be seen by viewing Table 8, the erosion rates at low mass fluxes, i.e. 0.164–2.22 lb/sec in$^2$, is negligible. In general as can be seen by viewing Tables 2–8 together, the erosion rates of the low density insulators of this invention are excellent, especially in view of the fact that the densities are lower than typical asbestos insulators.

TABLE 8

| Location/Motor No. | Mass Flux, lb/sec-in.$^2$ | Velocity ft/sec | A ER[1] | A DR[2] | B ER | B DR | C ER | C DR | D ER | D DR | E ER | E DR |
|---|---|---|---|---|---|---|---|---|---|---|---|---|
| Wall Section | | | | | | | | | | | | |
| Motor No. 1 | 0.164 | 67 | +2 | 7 | 0 | 8 | 1 | 6 | 0 | 7 | 3 | 6 |
| 2 | 0.237 | 42 | 4 | 11 | 3 | 12 | 2 | 7 | 2 | 8 | 1 | 7 |
| 3 | 0.222 | 44 | +2 | 8 | +3 | 7 | +2 | 6 | +5 | 4 | +3 | 4 |
| Ramp Section | | | | | | | | | | | | |
| Motor No. 1 | 0.385 | 104 | | | | | | | +7 | 6 | | |
| | 0.485 | 130 | | | | | | | +2 | 7 | | |
| 2 | 0.558 | 97 | | | | | | | | | | |
| | 0.700 | 121 | | | | | | | | | | |
| 3 | 0.529 | 104 | | | | | | | | | | |
| | 0.675 | 132 | | | | | | | | | | |
| 4 | 0.521 | 105 | | | | | | | +6 | 3 | | |
| | 0.663 | 135 | | | | | | | +6 | 5 | | |

EXAMPLE 3

Following the procedures generally set forth in Example 1, insulator formulations of Tables 9 and 10 were compounded, cured and tested with the results of the testing also shown in Tables 9 and 10, respectively. Composition 3A, a composition without polyisoprene supplemental elastomer, had lesser processing properties including tack compared to compositions 3B, C, D, E and F which included the polyisoprene supplemental elastomer. The overall mechanical and erosive properties were not significantly degraded with the inclusion of the supplemental polyisoprene elastomer.

TABLE 9

| Ingredient, phr | 3A | 3B | 3C | 3D | 3D | 3F |
|---|---|---|---|---|---|---|
| EPDM[a] | 100.0 | 90.0 | 80.0 | 80.0 | 80.0 | 80.0 |
| Polyisoprene[b] | | 10.0 | 10.0 | 20.0 | 20.0 | 20.0 |
| 2,5-dimethyl-2,5-di-(t-butyl-peroxy) hexane[c] | 2.5 | 2.5 | 2.5 | 2.5 | 2.5 | 2.5 |
| Chlorinated compound[d] | 40.0 | 40.0 | 40.0 | 40.0 | 40.0 | 40.0 |
| Antimony Oxide | 20.0 | 20.0 | 20.0 | 20.0 | 20.0 | 20.0 |
| Aramide Pulp[e] | 20.0 | 20.0 | 20.0 | 20.0 | 20.0 | 20.0 |
| Unmodified Decarboxylated Abietic Acid[f] | | | 5.0 | | 5.0 | |
| Styrenated Phenol Antioxidant[g] | | | | 1.0 | | 1.0 |
| Cotton Flock[h] | | | | | | 20.0 |
| Liquid Polybutadiene Rubber[i] | 10.0 | | | | | |
| Mechanical Properties (20 in./minute Crosshead, 77 F) | | | | | | |
| $\epsilon_m$, % | 10 | 30 | 30 | 40 | 30 | 20 |
| $\sigma_m$, MPa (psi) | 11.3 (1645) | 4.7 (679) | 9.5 (1384) | 6.5 (947) | 6.5 (948) | 8.2 (1184) |
| Hardness, Shore A | 85 | 72 | 78 | 78 | 78 | 80 |
| Extrusion, 77 C, cm/s-MPa | 0.284 | 0.143 | | 0.34 | 0.337 | |
| Mooney, ML1-4 (100 C) | | | | 67.4 | 58 | |
| Erosion Data* | | | | | | |
| Erosion Rate, mm/s | 0.001 | +0.024 | Poor | 0.019 | 0.024 | |
| Char Rate, mm/s | 0.244 | 0.297 | Cure | 0.272 | 0.273 | |
| Decomposition Rate, mm/s | 0.245 | 0.271 | | 0.291 | 0.299 | |

*2-in. motor, mass flux = 172.3 kg/s-M$^2$
[a]Nordel ® 1040 product of E. I. duPont.
[b]Natsyn ® 2200 product of Goodyear Tire and Rubber having a Mooney Viscosity of 70–90.
[c]Varox product of R. T. Vanderbilt.
[d]Dechlorane plus.
[e]Kevlar ® 29 Pulp product of E. I. duPont.
[f]N-Rosin Oil, product of Harwick.
[g]Vanox 102, product of R. T. Vanderbilt.
[h]Available as Akraflock.
[i]Available as Butarez ® NF from Phillips Petroleum.

TABLE 10

| Ingredient, phr | 3G | 3H | 3I | 3J |
|---|---|---|---|---|
| EPDM[a] | 80.0 | 85.0 | 90.0 | 80.0 |
| Tackifier[b] | | 15.0 | | |
| 2,5-dimethyl-2,5-di-(t-butyl-peroxy) hexane[c] | 2.5 | 2.5 | 2.5 | 2.5 |
| Polyaramide Pulp[c] | 50.0 | 50.0 | 50.0 | 50.0 |
| Silica[d] | 20.0 | 20.0 | 20.0 | 20.0 |
| Unmodified Decarboxylated Abietic Acid[e] | | | 5.0 | |
| Liquid Polybutadiene[f] | 20.0 | | 5.0 | |
| Polyisoprene[g] | | | | 20.0 |
| Polyethylene Glycol[h] | | | | 5.0 |
| Mechanical Properties (20 in./minute Crosshead, 77 F) | | | | |
| $\epsilon_m$, % | 10 | 20 | 10 | 20 |
| $\sigma_m$, MPa (psi) | 16.9 | 8.1 | 7.9 | 9.5 |

TABLE 10-continued

| Ingredient, phr | 3G | 3H | 3I | 3J |
|---|---|---|---|---|
| | (2446) | (1177) | (1153) | (1384) |
| Hardness, Shore A | 95 | 88 | 85 | 88 |
| Extrusion, 77 C, cm/s-MPa | 0.131 | 0.384 | 0.406 | 0.486 |
| Mooney, ML1-4 (100 C) | 187 | 165 | | 144 |
| Erosion Data* | | | | |
| Erosion Rate, mm/s | | 0.072 | +0.024 | +0.03 |
| Char Rate, mm/s | | 0.120 | 0.204 | 0.216 |
| Decomposition Rate, mm/s | 0.196 | 0.192 | 0.180 | 0.186 |

*2-in. motor, mass flux = 172.3 kg/s-M$^2$
[a]See Table 9, footnote (a).
[b]Bunaweld 780.

EXAMPLE 4

Using the procedures of Example 1 a series of chlorosulfonated polyethylene elastomers were compounded, cured and tested with results of the testing, as well as the formulations of the series, shown in Tables 11 and 12. Formulations of this invention have improved green properties and processability when the polyisoprene supplemental elastomer was included. In addition, inclusion of the polyisoprene supplemental elastomer does not detract from the important erosion resistance of the formulations.

TABLE 11

| Ingredient, phr | 4A | 4B | 4C | 4D | 4E | 4F | 4G | 4H | 4I | 4J | 4K |
|---|---|---|---|---|---|---|---|---|---|---|---|
| Chlorosulfonated Polyethylene[a] | 50.0 | 100.0 | 80.0 | 80.0 | 100.0 | 100.0 | 100.0 | 100.0 | 80.0 | 100.0 | 100.0 |
| Magnesium Oxide | 2.0 | 6.0 | 6.0 | 6.0 | 6.0 | 6.0 | 6.0 | 6.0 | 6.0 | 6.0 | 6.0 |
| Dipentylmethylenethiuriumhexanifide[b] | 1.0 | 1.0 | 1.0 | 1.0 | 1.0 | 1.0 | 1.0 | 1.0 | 1.0 | 1.0 | 1.0 |
| Starch | 40.0 | 40.0 | 40.0 | 40.0 | 40.0 | 40.0 | 40.0 | 40.0 | 40.0 | 40.0 | 40.0 |
| Phenolic Resin[c] | 100.0 | 100.0 | 100.0 | 100.0 | 100.0 | 100.0 | 100.0 | 100.0 | 100.0 | 100.0 | 100.0 |
| Polyaramid Pulp[d] | 50.0 | 50.0 | 50.0 | 50.0 | 50.0 | 50.0 | 50.0 | 50.0 | 50.0 | 50.0 | 50.0 |
| Styrenated Phenol Antioxidant[e] | | 10.0 | 10.0 | | 10.0 | 15.0 | 20.0 | 20.0 | 20.0 | 30.0 | 30.0 |
| Polyisoprene[f] | 20.0 | | 20.0 | 20.0 | | | | | 20.0 | | |
| Unmodified Decarboxylated Abietic Acid[g] | | | | | 5.0 | | | 5.0 | | 5.0 | |
| Curing Agent[h] | 3.75 | | | | | | | | | | |
| Liquid Polybutadiene[i] | 30.0 | | | | | | | | | | |
| Aromatic Plasticizer (tackifier)[j] | | | | 10.0 | | | | | | | |
| Mechanical Properties (20 in./minute Crosshead, 77F) | | | | | | | | | | | |
| $\epsilon_m$, % | 10 | 10 | 10 | 10 | 10 | 10 | 10 | 10 | | | |
| $\sigma_m$, MPa (psi) | 11.86 (1721) | 33.1 (4800) | 30.3 (4400) | 29.3 (4243) | 39.8 (5766) | 33.7 (4894) | 42.6 (6182) | 43.6 (6329) | 35.3 (5125) | 45.4 (6586) | 43.1 (6249) |
| Hardness, Shore A | 92 | 98 | 98 | 98 | 99 | 98 | 99 | 98 | 98 | 100 | 100 |
| Extrusion, 77 C, s-MPa | 0.069 | 0.143 | 0.09 | 0.179 | 0.103 | 0.089 | 0.098 | 0.066 | 0.128 | 0.188 | 0.134 |
| Mooney, ML1-4 (100 C) | | | | | | 107 | 171 | 158 | 134 | | |
| Erosion Data* | | | | | | | | | | | |
| Erosion Rate, mm/s | +0.076 | 0.01 | +0.024 | +0.043 | +0.086 | +0.108 | +0.114 | +0.076 | +0.075 | +0.179 | +0.149 |
| Char Rate, mm/s | 0.178 | 0.276 | 0.279 | 0.215 | 0.316 | 0.308 | 0.3116 | 0.33 | 0.29 | 0.357 | 0.295 |
| Decomposition Rate, mm/s | 0.254 | 0.266 | 0.255 | 0.172 | 0.233 | 0.200 | 0.202 | 0.254 | 0.215 | 0.178 | 0.147 |

*2-in motor, mass flux = 172.3 kg/s-M$^2$
[a]Hypolon ® LD 399 rubber from duPont.
[b]Tetrone A ® accelerator from duPont.
[c]Resinox 755 from Monsanto.
[d]Kevlar ® Pulp from duPont.
[e]Vanox ® 102 from R. T. Vanderbilt (see Table 9).
[f]Natsyn ® 2200 from Goodyear.
[g]N. Rosin ® Oil tackifier from Harwick.
[h]Varox ® from R. T. Vanderbilt.
[i]Ricon ® 150 from Colorado Specialty Chemical.
[j]Piccocizer ® M-30 from Hercules Incorporated.

[c]See Table 9, footnote (c).
[d]HiSil from R. T. Vanderbilt.
[e]N-Rosin Oil.
[f]Ricon 150 from Colorado Specialty Chemicals.
[g]See Table 9, footnote (b).
[h]PEG 4000 from Dow Chemical Corp.

TABLE 12

| Ingredient, phr | 4L | 4M | 4N | 40 | 4P |
|---|---|---|---|---|---|
| Chlorosulfonated Polyethylene[a] | 75.0 | 80.0 | 80.0 | 100.0 | 80.0 |
| Magnesium Oxide | 3.0 | 3.0 | 3.0 | 3.0 | 3.0 |
| Oipentylmethylenethiuriumhexasulfide[b] | 1.0 | 1.0 | 1.0 | 1.0 | 1.0 |
| Polyaramide Pulp[c] | 50.0 | 50.0 | 50.0 | 50.0 | 50.0 |
| Hydrated silica[d] | 20.0 | 20.0 | 20.0 | 20.0 | 20.0 |
| Tackifier[e] | 15.0 | 15.0 | 15.0 | | |
| Polyisoprene[f] | 10.0 | | | | |
| Pentaethyritol[g] | 1.5 | 1.5 | 1.5 | 1.5 | 1.5 |
| Polyethyleneglycol[h] | | 5.0 | | | 5.0 |
| Unmodified Dicarboxylated Abietic Acid[i] | | | 5.0 | | |

TABLE 12-continued

| Ingredient, phr | 4L | 4M | 4N | 40 | 4P |
|---|---|---|---|---|---|
| Styrenated Phenol Antioxidant[j] | | | | 20.0 | |
| Liquid Polybutadiene[k] | | | | | 15.0 |
| Mechanical Properties (20 in./minute Crosshead, 77 F) | | | | | |
| $\epsilon_m$, % | 10 | 10 | 10 | 10 | 15 |
| $\sigma_m$, MPa (psi) | 28.1 (4072) | 23.7 (3443) | 27.2 (3946) | 22.3 (3229) | 33.2 (4810) |
| Hardness, Shore A | 95 | 95 | 95 | 93 | 95 |
| Extrusion, 77 C, cm/s-MPa | 0.161 | 0.206 | 0.221 | 0.274 | 0.099 |
| Mooney, ML1-4 (100 C) | 150.5 | 164 | 164 | 131 | |
| Erosion Data* | | | | | |
| Erosion Rate, mm/s | +0.013 | +0.014 | +0.029 | 0.017 | +0.013 |
| Char Rate, mm/s | 0.212 | 0.343 | 0.304 | 0.251 | 0.209 |
| Decomposition Rate, mm/s | 0.199 | 0.182 | 0.275 | 0.235 | 0.196 |

*2-in. motor, mass flux = 172.3 kg/s-M$^2$
[a]See footnote (a) Table 11.
[b]See footnote (b) Table 11.
[c]See footnote (d) Table 11.
[d]HiSil ® 233 silica from PPG.
[e]Bunaweld 780.
[f]See footnote (f) Table 11.
[g]P.E. 200 from Hercules Incorporated.
[h]PEG 400 from Dow Chemical.
[i]See footnote (g) Table 11.
[j]See footnote (e) Table 11.
[k]See footnote (i) Table 11.

What is claimed is:

1. A method of insulating a rocket motor case which comprises (a) providing a compound comprising 100 parts by weight of a crosslinkable, substantially saturated elastomeric polymer; about 5–50 parts by weight of a crosslinkable, substantially unsaturated elastomeric polymer; about 5–85 parts by weight of a polyaramide pulp; about 0–120 parts by weight particulate selected from inorganic and organic particulates and about 1–15 parts by weight peroxide crosslinker and combinations thereof; (b) forming a ribbon by extruding or calendaring said compound; and (c) winding said ribbon around a workpiece having a central longitudinal axis so as to adjacently position and tack together integral segments of said ribbon around said axis.

2. The method in accordance with claim 1, wherein said crosslinkable, substantially saturated elastomer polymer comprises EPDM and said crosslinkable, unsaturated elastomer polymer comprises polyisoprene.

3. The method in accordance with claim 2, wherein said particulate comprises silica.

4. The method in accordance with claim 2, wherein said particulate comprises antimony oxide and a chlorinated hydrocarbon particulate.

5. A method in accordance with claim 1, wherein said substantially saturated elastomer polymer comprises a chlorosulfonated polymer and said particulate consists essentially of an organic particulate comprising a phenolic resin.

6. The method in accordance with claim 6, wherein said substantially unsaturated elastomeric polymer comprises a polyisoprene polymer.

7. An elastomeric composition suitable for making insulation of rocket motor cases, said composition comprising:

(a) 100 parts by weight of a substantially saturated, crosslinkable, elastomeric polymer;
(b) about 5–50 parts by weight of a substantially unsaturated elastomeric polymer;
(c) about 5–85 parts by weight of a polyaramide pulp;
(d) about 0–120 parts by weight of other particulate selected from organic and inorganic particulate, and
(e) about 1–15 parts by weight peroxide crosslinker.

8. The composition according to claim 7, wherein said substantially saturated, crosslinkable elastomeric polymer consists essentially of EPDM.

9. The composition in accordance with claim 8, wherein said substantially unsaturated, crosslinkable elastomeric polymer consists essentially of polyisoprene.

10. The composition in accordance with claim 9, wherein said other particulate comprises silica present in an amount between about 5 and 75 parts by weight.

11. The composition in accordance with claim 9, wherein said other particulate comprises antimony oxide and chlorinated hydrocarbon present in an amount between 5 and 75 parts by weight.

12. The composition in accordance with claim 7, wherein said substantially saturated, crosslinkable elastomeric polymer comprises chlorosulfonated polyethylene.

13. The composition in accordance with claim 12, wherein said substantially unsaturated crosslinkable elastomeric polymer consists essentially of polyisoprene.

14. The composition in accordance with claim 13, which includes magnesium oxide.

* * * * *

UNITED STATES PATENT AND TRADEMARK OFFICE

CERTIFICATE OF CORRECTION

PATENT NO. : 4,878,431
DATED : November 7, 1989
INVENTOR(S) : Liles G. Herring

It is certified that error appears in the above-identified patent and that said Letters Patent is hereby corrected as shown below:

Column 15, in the foot note of Table 11 -

" (d)Kelvar$^{R}$ Pulp from duPont "

should read -- (d)Kelvar$^{R}$ 29 Pulp from duPont --

Signed and Sealed this

Sixth Day of November, 1990

*Attest:*

HARRY F. MANBECK, JR.

*Attesting Officer*

*Commissioner of Patents and Trademarks*